US008028728B2

(12) United States Patent
Cooper

(10) Patent No.: US 8,028,728 B2
(45) Date of Patent: Oct. 4, 2011

(54) DISPENSING APPARATUS AND METHOD FOR DETERMINING THE LOCATION OF A CONTAINER

(75) Inventor: Anthony A. Cooper, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 1036 days.

(21) Appl. No.: 11/856,093

(22) Filed: Sep. 17, 2007

(65) Prior Publication Data

US 2009/0071567 A1 Mar. 19, 2009

(51) Int. Cl.
*B65B 3/04* (2006.01)

(52) U.S. Cl. ..... 141/351; 141/94; 141/98; 141/192; 62/126; 62/389; 222/146.6

(58) Field of Classification Search ..... 141/1, 83, 141/94, 98, 104, 192, 351, 360; 222/146.6; 62/126, 389
See application file for complete search history.

(56) References Cited

U.S. PATENT DOCUMENTS

| | | | | |
|---|---|---|---|---|
| 4,559,979 | A * | 12/1985 | Koblasz et al. | 141/9 |
| 4,883,100 | A * | 11/1989 | Stembridge et al. | 141/1 |
| 6,058,718 | A | 5/2000 | Forsberg et al. | |
| 6,100,518 | A * | 8/2000 | Miller | 141/1 |
| 6,417,602 | B1 | 7/2002 | Agam et al. | |
| 6,688,134 | B2 * | 2/2004 | Barton et al. | 141/351 |
| 6,705,356 | B2 * | 3/2004 | Barton et al. | 141/198 |
| 6,789,585 | B1 * | 9/2004 | Janke | 141/198 |
| 6,882,280 | B2 | 4/2005 | Ferragut, II | |
| 6,993,485 | B2 | 1/2006 | Ferragut, II et al. | |
| 7,028,725 | B2 * | 4/2006 | Hooker | 141/141 |
| 7,201,005 | B2 | 4/2007 | Voglewede et al. | |
| 7,543,453 | B2 * | 6/2009 | Boarman et al. | 62/98 |
| 7,658,212 | B2 * | 2/2010 | Meuleners et al. | 141/82 |
| 7,661,448 | B2 * | 2/2010 | Kim et al. | 141/94 |
| 7,673,661 | B2 * | 3/2010 | Chase et al. | 141/360 |
| 7,677,053 | B2 * | 3/2010 | Truitt | 141/360 |
| 7,690,403 | B2 * | 4/2010 | You et al. | 141/83 |
| 7,743,801 | B2 * | 6/2010 | Janardhanam et al. | 141/351 |
| 7,845,375 | B2 * | 12/2010 | Dorney | 141/94 |
| 2004/0211210 | A1 | 10/2004 | Crisp, III | |
| 2005/0268624 | A1 * | 12/2005 | Voglewede et al. | 62/126 |

* cited by examiner

*Primary Examiner* — Gregory Huson
*Assistant Examiner* — Nicolas A Arnett
(74) *Attorney, Agent, or Firm* — Global Patent Operation; Douglas D. Zhang

(57) ABSTRACT

A dispensing apparatus for determining a location of a container into which at least one of a liquid and ice is dispensed from a refrigerator. A sensor is configured to sense a position of the container, without contacting the container, and to send a first signal indicating the sensed position. A microprocessor is configured to receive the first signal and to send a second signal based on the first signal. An indicator is configured to receive the second signal and to indicate the position of the container.

11 Claims, 2 Drawing Sheets

DISPENSING APPARATUS AND METHOD FOR DETERMINING THE LOCATION OF A CONTAINER

BACKGROUND OF THE INVENTION

The described technology relates to a dispensing apparatus, such as a water and/or ice dispensing apparatus for a refrigerator, and a corresponding method.

It is known to provide a refrigerator with a dispenser that dispenses water and ice. One type of known refrigerator is a so-called side-by-side refrigerator that includes a freezer section disposed to the side of a fresh food section. In the known side-by-side refrigerator, the water from a source exterior to the refrigerator is dispensed by a dispenser disposed in a door of the freezer section. The dispenser also dispenses the ice previously formed and held in the freezer section.

Another type of known refrigerator is a so-called bottom freezer or bottom mount freezer refrigerator, which includes a bottom freezer section disposed below a top fresh food section. In a manner similar to that of the known side-by-side refrigerator, in the known bottom freezer refrigerator the water is dispensed by a dispenser disposed in a door of the fresh food section. Again, the dispenser dispenses the ice previously held in the freezer section.

Each of these known dispensers includes a dispenser opening disposed in the door of the freezer or fresh food section, which receives a container (e.g., a drinking glass) suitable for receiving and holding the water and ice. The known dispenser includes a paddle or cradle, with which the container must be brought into contact to dispense the water and ice. The shape, location and other characteristics of the cradle serve as visual and physical cues of a position at which the water and ice is to be dispensed.

BRIEF DESCRIPTION OF EMBODIMENTS OF THE INVENTION

As described herein, embodiments of the invention overcome one or more disadvantages of a known dispensing apparatus.

In an embodiment, the invention provides a dispensing apparatus for determining a location of a container into which at least one of a liquid and ice is dispensed from a refrigerator. A sensor is configured to sense a position of the container, without contacting the container, and to send a first signal indicating the sensed position. A microprocessor is configured to receive the first signal and to send a second signal based on the first signal. An indicator is configured to receive the second signal and to indicate the position of the container.

In another embodiment, the invention provides a dispensing apparatus for determining a location of a container into which at least one of a liquid and ice is dispensed from a refrigerator. The apparatus includes means for sensing a position of the container without contacting the container, the means for sensing configured to send a first signal indicating the sensed position, means for sending a second signal based on the first signal, and means for indicating the position of the container based on the second signal.

In still another embodiment, the invention provides a method of dispensing at least one of a liquid and ice from a refrigerator to a container. The method includes sensing a position of a container without contacting the container, determining whether the container is in a position to receive at least one of the liquid and ice, indicating whether the container is in the position, and dispensing the at least one of the liquid and ice when the container is in the position.

BRIEF DESCRIPTION OF THE DRAWINGS

The following figures illustrate examples of embodiments of the invention. The figures are described in detail below.

DETAILED DESCRIPTION OF EMBODIMENTS OF THE INVENTION

Embodiments of the invention are described below, with reference to the figures. Throughout the figures, like reference numbers indicate the same or similar components.

Figure 2:
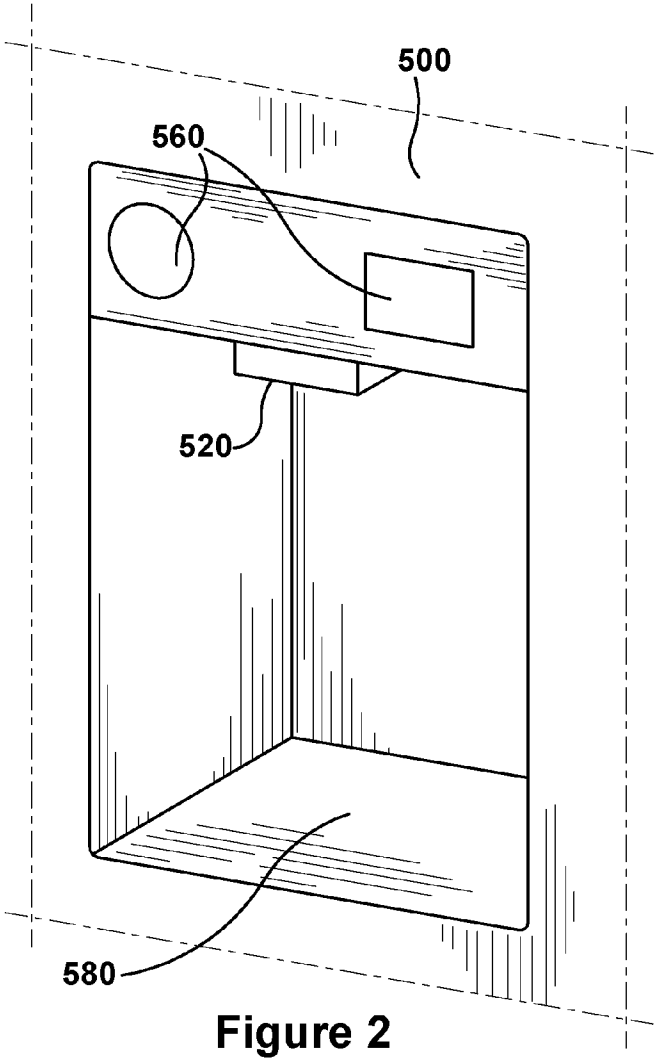
FIG. 2 is a detail isometric view of the dispensing apparatus of FIG. 1.
Figure 1:
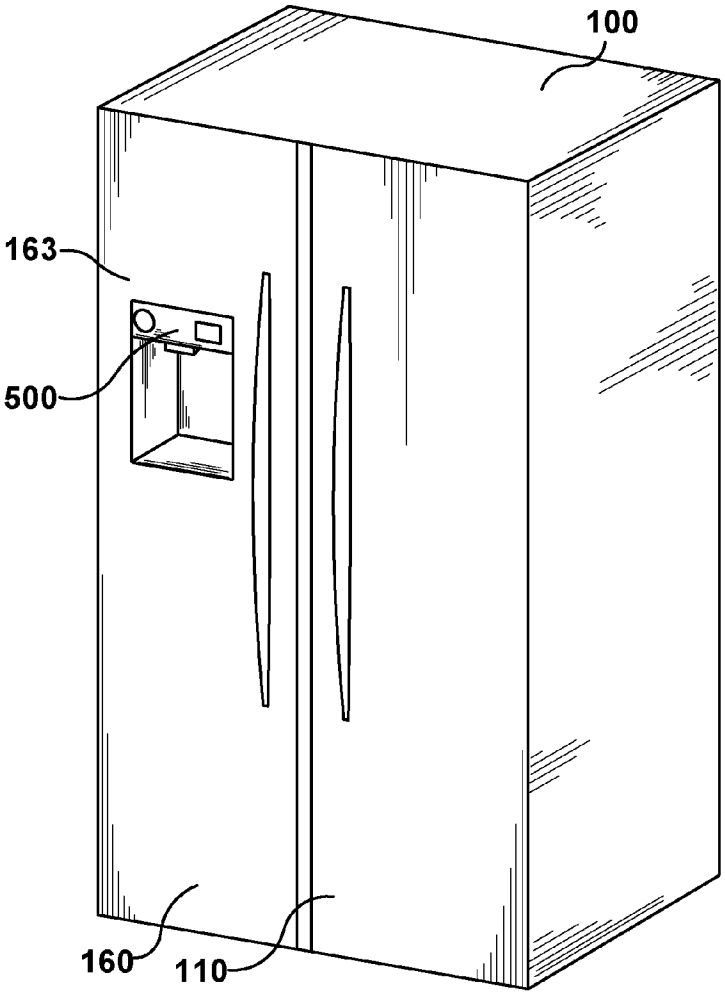
FIG. 1 is an isometric view of a refrigerator including a dispensing apparatus.
Figure 3:
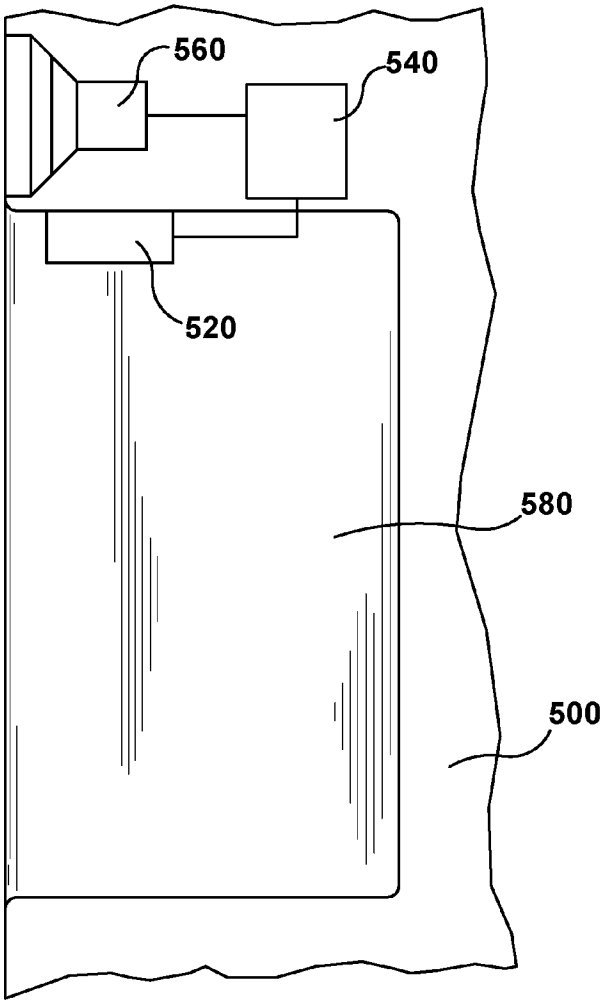
FIG. 3 is a side cross sectional view of the dispensing apparatus of FIGS. 1 and 2.

FIGS. 1 and 2 are isometric views of a refrigerator including a dispensing apparatus and the dispensing apparatus itself, respectively, while FIG. 3 is a side cross sectional view of the dispensing apparatus. It is noted that the figures show embodiments of the dispensing apparatus for determining a location of a container into which at least one of a liquid and ice is dispensed from the refrigerator. The at least one of the liquid and ice can be dispensed by one or more known mechanisms and/or known dispensers, which are well known to one of ordinary skill in the art, and therefore are omitted from the drawings for the sake of clarity.

As shown in the figures, a side-by-side refrigerator 100 includes a fresh food section 110 and a freezer section 160. The fresh food section 110 is configured to store foodstuffs, beverages and/or other items at a temperature greater than a freezing point temperature of water, in a known manner. The freezer section 160 is configured to store foodstuffs, beverages and/or other items at a temperature less than the freezing point temperature of water, also in a known manner. In an embodiment shown in the drawings, the dispensing apparatus 500 (discussed in further detail below) is disposed in, and is configured to dispense the liquid (e.g., water) and/or ice through an opening in, a door 163 of the freezer section 160.

Although the figures show the dispensing apparatus 500 disposed in the door 163, it is to be understood that the dispensing apparatus 500 is not limited to being disposed in any specific location in the side-by-side refrigerator 100, and is not limited to use with the side-by-side refrigerator 100. By way of specific non-limiting examples, the dispensing apparatus 500 can be disposed in a door of the fresh food section 110 of the side-by-side refrigerator 100, or can be disposed in any door or compartment of the side-by-side refrigerator 100 that includes two or more fresh food sections 110 or two or more freezer sections 160. Alternately, the dispensing apparatus 500 can be disposed in another type of refrigerator (e.g., a bottom freezer refrigerator, a top freezer refrigerator, or a chest freezer or an upright freezer that does not include a fresh food section), or can be disposed in another appliance that is not a refrigerator and therefore does not include a fresh food section and does not include a freezer section.

As shown in the figures, the dispensing apparatus 500 includes, among other components included in a known dispenser that dispenses water and ice in a refrigerator, a sensor 520, a processor 540, an indicator 560 and a dispenser opening 580.

In an embodiment of the invention, the sensor 520 is configured to sense a position of a container (e.g., a drinking glass) suitable for receiving and holding the liquid and/or ice that is dispensed from the dispensing apparatus 500, when at least a portion of the container is disposed in the dispenser opening 580. The processor 540 is configured to receive a signal that is sent from the sensor 520, to process the signal, and to send a second signal to the indicator 560. The indicator 560 is configured to indicate the position of the container, such that the liquid and/or ice can be dispensed into the container.

More specifically, in an embodiment of the invention, the sensor 520 is configured to sense when the container is at a position where the liquid and/or ice is to be dispensed from the dispensing apparatus 500 (referred to as the dispensing position), and/or to sense when the container is adjacent to the dispensing position. It is to be understood that the term "dispensing position" can refer to a single discrete position, or to a locus of positions, at which the container can receive and hold the liquid and/or ice dispensed by the dispensing apparatus 500. The sensor 520 is configured to send one or more signals indicating that the container is in and/or adjacent the dispensing position (i.e., the sensor 520 is configured to send multiple, different signals based on or corresponding to multiple, different locations of the container, such that the sensor 520 is configured to indicate the location of the sensor 520). The sensor 520 can be an ultrasonic sensor, such as that disclosed in U.S. Pat. No. 6,417,602, which is incorporated by reference herein in its entirety. It is to be understood, however, that the sensor 520 is not limited to the sensor disclosed in the above patent, and is not limited to being an ultrasonic sensor. By way of specific non-limiting examples, the sensor can be an optical sensor, or can be another type of sensor. In an embodiment of the invention, the sensor 520 is a non-contact sensor, which senses or determines a position or location of the container without any or independent of direct, physical contact between any portion of the dispensing apparatus 500 (including the sensor 520) and the container.

The sensor 520 can, but need not, be configured to ultimately control one or more known mechanisms and/or known dispensers that deliver the liquid and/or ice to the container. By way of specific non-limiting examples, the known dispenser can be configured to receive a signal sent from the sensor 520, and/or a signal sent from the processor 540 corresponding to or based on the signal sent by the sensor 520. By this arrangement, the dispensing apparatus 500 can be configured such that the sensor 520 operates the known dispenser to dispense the liquid and/or ice (e.g., such that dispensing of the liquid and/or ice occurs when the container is sensed by the sensor 520 to be in the dispensing position, such as for a predetermined period of time), or the dispensing apparatus 500 can be configured such that the sensor 520 permits operation of the known dispenser to dispense the liquid and/or ice (e.g., such that dispensing of the liquid and/or ice occurs when the container is sensed by the sensor 520 to be in the dispensing position, such as for a predetermined period of time, and a separate button is operated). In each case, it is understood that the dispensing of the liquid and/or ice can be limited to when the container is in the dispensing position, as sensed by the sensor 520.

In the event that the sensor 520 is not configured to ultimately control one or more known dispensers that deliver the liquid and/or ice to the container, another known mechanism can be used. Such mechanisms are well known to one of ordinary skill in the art, and therefore are not further discussed in this disclosure.

Although the drawings show a single sensor 520, which can be configured to both send a signal and receive a signal to determine the position or location of the container, it is to be understood that the sensor 520 can include multiple sensors, such as a first sensor configured to send a signal and a second sensor configured to receive a signal, to determine the position or location of the container.

The indicator 560 is configured to indicate when the container is in and/or adjacent the dispensing position, by receiving signals from the processor 540 that indicate or correspond to the position of the container. In an embodiment of the invention, the indicator 560 can be configured to provide an audible indication in response to the second signal sent by the processor 540. The audible indication can be emitted when the container is in the dispensing position. In another embodiment, the indicator 560 can be configured to provide multiple audible indications. A first audible indication can be emitted when the container is adjacent the dispensing position, and a second audible indication can be emitted when the container is in the dispensing position. In still another embodiment, a first audible indication can be emitted when the container is in an outermost portion of the dispensing position, and a second audible indication can be emitted when the container is closer to and/or in a center portion of the dispensing position. In still another embodiment, a first audible indication can be emitted when the container is adjacent the dispensing position, a second audible indication can be emitted when the container is in an outermost portion of the dispensing position, and a third audible indication can be emitted when the container is closer to and/or in a center portion of the dispensing position. In any or every of the above-discussed cases, the audible indication can cease being emitted when the container is removed from the dispensing position and/or from being adjacent the dispensing position. The first, second and/or third audible indications can differ from one another in any characteristic, such as but not limited to one or more of a pitch, tone, volume and/or intensity. A non-limiting example of the indicator 560 that can emit the audible indication is a speaker, such as a buzzer.

In an alternate embodiment of the invention, the indicator 560 can be configured to provide a visual indication in response to the second signal sent by the processor 540. The visual indication can be emitted when the container is in the dispensing position. In another embodiment, the indicator 560 can be configured to provide multiple visual indications. A first visual indication can be emitted when the container is adjacent the dispensing position, and a second visual indication can be emitted when the container is in the dispensing position. In still another embodiment, a first visual indication can be emitted when the container is in an outermost portion of the dispensing position, and a second visual indication can be emitted when the container is closer to and/or in a center portion of the dispensing position. In still another embodiment, a first visual indication can be emitted when the container is adjacent the dispensing position, a second visual indication can be emitted when the container is in an outermost portion of the dispensing position, and a third visual indication can be emitted when the container is closer to and/or in a center portion of the dispensing position. In any or every of the above-discussed cases, the visual indication can cease being emitted when the container is removed from the dispensing position and/or from being adjacent the dispensing position. The first, second and/or third visual indications can differ from one another in any characteristic, such as but not limited to one or more of a color, intensity, brightness and/or size. Non-limiting examples of the indicator 560 that can emit a visual indication include a light emitting diode (LED) or liquid crystal display (LCD). It is to be understood that the indicator 560 can emit the visual indication in place of, or in conjunction with, the audible indication.

The processor 540 can be any structure configured to receive the signal from the sensor 520 and to send the second signal to the indicator 560 which is based on or corresponds to the signal from the sensor 520, consistent with the above discussion. A non-limiting example of the processor 540 is a microprocessor.

As discussed above, the dispenser opening 580 is configured such that at least a portion of the container can be disposed therein, so that the container can receive the liquid and/or ice from the dispensing apparatus 500. In an embodiment of the invention, the dispenser opening 580 is sized and shaped to accommodate a drinking glass of a size that is commonly used. In an embodiment of the invention, the dispenser opening 580 includes one or more landmarks or other visual cues, such as on a bottom surface thereof, which marks an at least approximate location of the dispensing position. Although the drawings show specific examples of the dispenser opening 580, it is to be understood that the dispenser opening 580 can have a different size, shape and/or location than illustrated, and can be omitted entirely from the dispensing apparatus 500. By way of specific non-limiting example, the dispensing apparatus 500 can be configured such that the container need not be disposed in any recess to receive the liquid and/or ice.

The dispensing apparatus 500 in accordance with above-discussed embodiments is configured to provide the audible and/or visual indication, indicating that the container is in and/or adjacent the dispensing position. Thus, a user of the dispensing apparatus 500 knows with certainty when the container is disposed to receive the liquid and/or ice, and can maintain the location of the container even when there is a delay in the dispensing of the liquid and/or ice (the delay being caused, for example, by a time associated with an opening of a valve to deliver the liquid or with a turning of an auger in an ice bucket to deliver the ice). Further, because the user knows with certainty when the container is disposed in the dispensing position, the user also knows with certainty when the container is brought outside of the dispensing position. Therefore, overfilling of the container can be avoided.

Thus, the dispensing apparatus 500 can provide a method of dispensing at least one of a liquid and ice from a refrigerator to a container. The method includes sensing a position of a container without contacting the container, determining whether the container is in a position to receive at least one of the liquid and ice, indicating whether the container is in the position, and dispensing the at least one of the liquid and ice when the container is in the position.

This written description uses examples to disclose embodiments of the invention, including the best mode, and also to enable a person of ordinary skill in the art to make and use embodiments of the invention. It is understood that the patentable scope of embodiments of the invention is defined by the claims, and can include additional components occurring to those skilled in the art. Such other arrangements are understood to be within the scope of the claims.

The invention claimed is:

1. A dispensing apparatus, comprising:

a sensor configured to sense a position of a container, without contacting the container, and to send a first signal representing the sensed position;

a processor configured to receive the first signal and to send a second signal based on the first signal; and an indicator configured to receive the second signal and to indicate the sensed position of the container, wherein the indicator is configured to emit a first indication when the container is sensed to be in a dispensing position to receive at least one of liquid and ice from the dispensing apparatus, and to emit a second indication when the container is sensed to be adjacent the dispensing position, the second indication being different from the first indication.

2. The dispensing apparatus of claim 1, wherein at least one of the first indication and the second indication comprises an audible indication.

3. The dispensing apparatus according to claim 2, wherein the indicator comprises a speaker.

4. The dispensing apparatus of claim 1, wherein at least one of the first indication and the second indication comprises a visual indication.

5. The dispensing apparatus according to claim 1, wherein the sensor comprises an ultrasonic sensor.

6. The dispensing apparatus accordingly to claim 5, wherein the indicator comprises a speaker.

7. The dispensing apparatus according to claim 1, further comprising:

a dispenser configured to dispense the at least one of liquid and ice to the container when the container is in the dispensing position.

8. A method of dispensing at least one of liquid and ice to a container, comprising:

sensing a position of the container without contacting the container;

determining whether the container is in a dispensing position to receive at least one of liquid and ice or is adjacent the dispensing position;

indicating when the container is in the dispensing position by emitting a first indication; and indicating when the container is adjacent the dispensing position by emitting a second indication which is different from the first indication.

9. The method according to claim 8, wherein at least one of the first indication and the second indication comprises an audible indication.

10. The method according to claim 8, wherein at least one of the first indication and the second indication comprises a visual indication.

11. The method according to claim 8, further comprising dispensing the at least one of liquid and ice when the container is in the dispensing position.

* * * * *